United States Patent [19]

Kulick et al.

[11] 4,039,353

[45] Aug. 2, 1977

[54] POST-TREATMENT OF CONVERSION-COATED METAL SURFACES

[75] Inventors: Leonard Kulick, Ferndale; John K. Howell, Jr., Rochester, both of Mich.

[73] Assignee: Oxy Metal Industries Corporation, Warren, Mich.

[21] Appl. No.: 631,787

[22] Filed: Nov. 13, 1975

Related U.S. Application Data

[63] Continuation of Ser. No. 518,002, Oct. 25, 1974.

[51] Int. Cl.[2] ..... C23F 7/10

[52] U.S. Cl. ..... 148/6.15 R; 148/6.15 Z; 148/6.2; 148/6.14 R; 260/29.4 R

[58] Field of Search ..... 148/6.15 R, 6.15 Z, 148/6.2, 6.14 R, 6.16; 427/409; 260/29.4 R

[56] References Cited

U.S. PATENT DOCUMENTS

| | | | |
|---|---|---|---|
| 1,303,627 | 5/1919 | Baines | 148/6.15 R |
| 2,854,368 | 9/1958 | Shreir | 148/6.15 R |
| 3,877,998 | 4/1975 | Guhde | 148/6.15 R |

FOREIGN PATENT DOCUMENTS

| | | | |
|---|---|---|---|
| 1,192,487 | 5/1965 | Germany | 148/6.15 R |

*Primary Examiner*—Ralph S. Kendall

*Attorney, Agent, or Firm*—Arthur E. Kluegel; Bertram F. Claeboe; Richard P. Mueller

[57] ABSTRACT

Disclosed is a process for the post-treatment of conversion-coated metal surfaces. The aqueous treating solution contains a melamine-formaldehyde resin and preferably contains a vegetable tannin and is free of chromium. Treatment with the melamine-formaldehyde resin-containing solution provides improved corrosion-resistance over that obtained with a water rinse and treatment with the melamine-formaldehyde resin and vegetable tannin combination solution gives corrosion results as measured by salt spray resistance comparable to those obtained with the use of the commercial dilute chromium-containing rinse.

18 Claims, No Drawings

POST-TREATMENT OF CONVERSION-COATED METAL SURFACES

This is a continuation of application Ser. No. 518,002, filed Oct. 25, 1974.

BACKGROUND OF THE INVENTION

The present invention relates to the art of metal surface treatment. More specifically, it relates to the art of post-treating a conversion-coated metal surface to impart improved corrosion-resistance thereto.

Numerous techniques have been developed for protecting metal surfaces against corrosion. Of these techniques, the most common is phosphatization of the metal surface. This is accomplished by contacting the metal surface with an aqueous solution containing phosphate ions so as to form on the surface a corrosion-resistant, non-reactive phosphate complex coating. Depending on the type of metal to be treated, the phosphate baths may be based upon an alkali metal and/or ammonium phosphate or, on the oter hand, may be a coating metal phosphate solution containing a coating metal ion such as zinc. Further corrosion-resistance is obtained by conventional means when the phosphatized surface is post-treated with a dilute aqueous acidic solution containing a chromium compound, usually a hexavalent chromium solution. Chromium and molybdate and complex oxide treatments are also employed.

The use of chromium-containing post-treatments, while satisfactory from a corrosion standpoint, has become environmentally objectionable. Accordingly, it would be desirable to develop a process for the post-treatment of a phosphatized metal surface which provides good corrosion resistance and paint adhesion characteristics without employing objectionable heavy metal compounds such as chromium.

SUMMARY OF THE INVENTION

The present invention provides a composition and process of post-treating a conversion-coated metal surface. The post-treatment process consists of contacting the conversion-coated metal surface with an aqueous solution containing a melamine-formaldehyde resin. When the thus-treated surface is painted and tested for corrosion resistance, results are far superior to a tap or deionized water-rinse. Even further improvements in corrosion-resistance are obtained if the posttreatment solution additionally contains a small quantity of a vegetable tannin. The melamine-formaldehyde-vegetable tannin solution produces anti-corrosion properties and physical characteristics such as point adhesion comparable to that obtained when the conventional dilute hexavalent chromium-containing composition is employed as a post-treatment.

DETAILED DESCRIPTION OF THE INVENTION

Various processes for forming conversion coatings on metallic surfaces have been described, for example, in Metal Handbook, Volume II, 8th Edition, pages 529 to 547 of the American Society for Metals, and in Metal Finishing Guidebook and Directory, pages 590 to 603 (1972), the contents of which are incorporated herein by reference. Typically, the process calls for the following steps:

1. Cleaning;
2. Water Rinsing;

3. The formation of a conversion coating by contact with a suitable phosphate, chromate, or similar conventional bath;
4. Water Rinsing;
5. Post-treating with a dilute hexavalent chromium-containing composition;
6. Optionally, drying the surface.

Zinc, iron and aluminum surfaces may all be conversion coated with suitable conversion-coated compositions. Examples of such metals include cold-rolled, ground, pickled and hot-rolled steel and galvanized steel. The process of the invention is capable of improving the corrosion-resistance of the subsequently painted metal surface no matter what type of phosphate conversion coating solution is employed.

The exact composition of the melamine-formaldehyde resin suitable for use in the present invention does not appear to be critical. Monomeric, dimeric, and higher order resins have been found suitable. As is well-known, formaldehyde methylolates the amine groups of the melamine heterocycle after which cross-linkage between the molecules takes place via condensation polymerization. The degree of methylolation is not critical although at least one mole of formaldehyde per mole of malamine is preferred and at least $1\frac{1}{2}$ moles of formaldehyde per mole of melamine is more preferred. The commercially available melamine-formaldehyde resins may also include various degrees of alkyl substitution with methyl, ethyl, propyl or butyl groups. Table I lists a number of the commercially-available melamine-formaldehyde resins along with their suppliers and identification code by which they will be referred to hereinafter. These resins are suitable for use in the present invention but the invention is not limited thereto. The range of concentration and pH values for suitable post-treatment results are selected depending upon the particular organic components employed. Improvements in the corrosion resistance as measured by the salt spray tests can be obtained at resin concentrations as low as 0.01 g/1. Increased concentrations produce further improvements in the corrosion resistance; however, excess resin concentrations, e.g., above 100 g/1 tend to cause the degradation in the corrosion resistance as measured by the humidity test. Preferably, the resin concentration should be maintained at a value of from 0.25 to 25 g/1 to obtain best over-all corrosion characteristics.

TABLE I

MELAMINE-FORMALDEHYDE RESINS

| Code | Name | Supplier |
|---|---|---|
| R1 | Cr2024 | Clark Chemical Corp. |
| R2 | Resin G-3 | Jersy State Chemical Co. |
| R3 | Mel-Iron A | Crown Metro Inc. |
| R4 | Schercomel Resin M | Scher Bros. Inc. |
| R5 | X-3387 | Cargill, Inc. |
| R6 | Uformite MM-83 | Rohm & Haas Co. |
| R7 | Resydrol WM 501 | American Hoechst Corp. |
| R8 | Resimene X 712 | Monsanto Co. |
| R9 | Resimene X 714 | Monsanto Co. |
| R10 | Resimene X 720 | Monsanto Co. |
| R11 | Resimene X 730 | Monsanto Co. |
| R12 | Resimene X 735 | Monsanto Co. |
| R13 | Resimene X 740 | Monsanto Co. |
| R14 | Cymel 370 | American Cyanamid Co. |
| R15 | Aerotex MW | American Cyanimid Co. |
| R16 | Aerotex 92 | American Cyanimid Co. |
| R17 | Tanak M3 | American Cyanamid Co. |
| R18 | Aerotex P225 | American Cyanamid Co. |
| R19 | Tanak MRX | American Cyanamid Co. |
| R20 | Cymel 7273-7 | American Cyanamid Co. |

Where the melamine-formaldehyde resin is employed without the tannin, a pH of from 2 to 10 should be employed with a range of from about 3 to 8 found most suitable. The pH adjustment may be performed with any acid or base such as phosphoric acid, sulphuric acid, or alkali metal or ammonium hydroxides.

In the preferred embodiment, the post-treating solution additionally contains a vegetable tannin material. The use of tannins for the treatment of metal surfaces in general has been described in U.S. Patents Nos. 1,798,218; Re 24,604; 566,037; 750,986; 1,079,453; 1,501,425; 1,817,174; 2,311,563; 2,854,368; 3,547,710; and 3,578,508. It has now been discovered that very small quantities of the tannin material, when included in combination with the melamine-formaldehyde resin, are very effective in increasing the anti-corrosion properties imparted by the post-treatment composition of the present invention. It is desirable to include at least .01 g/1 of the vegetable tannin in the solution, preferably, the weight ratio of resin to tannin is at least 1:1. More preferably, the weight ratio of the resin to the tannin is at least about 3.75:1 and most preferably at least about 7.5:1. Table II lists names of various tannins which may be employed in the present invention together with the suppliers and identification codes. Other tannins are also suitable.

The pH to which the post-treatment solution should be adjusted may be readily determined for a particular resin-tannin combination by simple experiments at different pH levels and values as low as pH 2 and as high as pH 10 have been found to yield suitable anti-corrosion properties with pH values of from 6 to 9 being preferred.

TABLE II

| TANNINS | | |
|---|---|---|
| Code | Name | Supplier |
| T1 | Tannic Acid | Merck & Co., Inc. |
| T2 | Tannic Acid (NPF11) | S. B. Penick & Co. |
| T3 | Tannic Acid (Tech. 3C) | The Harshaw Chemical Co. |
| T4 | Tannic Acid (Tech. XXX) | " |
| T5 | Tannic Acid (Tech 7c) | " |
| T6 | Chestnut Extract | The Mead Corp. |
| T7 | Spray Dried Chestnut | Arthur C. Trask Corp. |
| T8 | Bisulfited Quebracho Extract | " |
| T9 | Non-bisulfited Quebracho Extract | " |
| T10 | Wattle Extract | " |
| T11 | Cutch Extract | " |

While the melamine-formaldehyde resin or tannin components may be separately supplied and dissolved in the aqueous working solution, they are more conveniently supplied as a concentrate composition containing an aqueous solution of from 1 to 80 weight % of the malamine-formaldehyde resin and 1 to 40 weight % of the vegetable tannin where the tannin is also to be employed. This concentrate may then be diluted to the desired concentration for use.

The method of drying the workpiece following the post-treatment will depend upon the desired anti-corrosive properties. While room-temperature drying may be employed, it is preferred to employ dry-off temperatures in excess of about 250°F.

Any conventional method of application such as spray-on, immersion, and roll-on are suitable.

Although the post-treatment solution may be heated, improved results are obtained operating at room temperatures or slightly above (e.g., 100°F). The period of contact between the metal surface and the post-treatment solution is not critical with periods of a half a minute producing excellent results.

The following descriptions are applicable to the examples:

SALT SPRAY CORROSION RESISTANCE

Salt spray corrosion resistance was measured in accordance with the product of ASTM B117-61. The panels were rated in terms of the amount of paint loss from a scribe in one-sixteenth inch increments (N for no loss of paint at any point). The principal numbers represent the general range of the creepage from the scribe along its length whereas the superscripts represent spot or non-representative creepage at the paint of maximum creepage along the length of the scribe. Thus, $2\text{-}7^{10s}$ means representative creepage varied from two-sixteenths to seven-sixteenths with a maximum of ten-sixteeths at one or two spots. Where corrosion was extensive, the results were expressed as percent peel over the entire panel surface, e.g., 60%P.

HUMIDITY CORROSION RESISTANCE

Humidity corrosion resistance was measured in accordance with the procedure of ASTM 2247-64T. The panels were rated in terms of the number and size of the blisters: F for few, M for medium and D for dense, and from 9 for very small size to 1 for very large. 10 represents no blisters. Where two rating is preceeded by a G or C, the panel gave a 10 rating except for blisters due to handling (G) or concentration effects (C) such as those which would result from solution run down.

TOTAL ACID

Milliliters of 0.1 NaOH added to a 10 ml. sample to the phenolphthalein end point.

FREE-ACID

Milliliters of 0.1 N NaOH added to a 10 ml. sample to the methyl orange or bromo-cresol green endpoint.

TABLE III

| Paints | | |
|---|---|---|
| Name | Description | Manufactured by |
| Dulux 704-6731 | White alkyd | DuPont Company |
| DuPont 963-72724 | White acrylic | " |
| PPG 222-1005 | Black Modified alkyd primer | PPG Industries, Inc. |
| Duracron 200 | Acrylic | " |

In the examples, all concentrations are net solids unless otherwise specified. The examples are for the purpose of illustrating the invention and are not intended to limit the scope thereof.

EXAMPLE 1

An aqueous acidic zinc phosphate coating solution was prepared in a five-gallon laboratory spray tank to contain 1.8 g/1 zinc ions, 6.1 g/1 phosphate ions, 0.11 g/1 nitrite ions, 0.12 g/1 nickel ions, and 0.3 g/1 fluoride and 2.0 g/1 nitrate ions. This solution was heated to 150°F, and when titrated in the conventional manner, was found to have a total acid of 12.0 points and a free acid of 0.8 point. In a second spray tank, a conventional alkaline cleaner was prepared at a concentration of 1 ounce per gallon and was heted to 145°F. In a third spray tank, a solution of a water soluble melamine-formaldehyde resin was prepared by dissolving 17.2 grams of resin R17 in 21.5 1 water and adjusting the pH to 4.5 with 25% $H_3PO_4$(80°F). A number of 4 × 12 inches SAE 1010, cold rolled steel panels (CRS) and 4 × 12 inch minimum spangle commercial hot-dipped galvanized panels (GALV), temper rolled one percent, were sprayed in the sequence one minute cleaner, one-half minute fresh warm water spray rinse, one minute zinc phosphating solution, one-half minute cold water rinse, and one-half minute resin solution, after which they were dried in a circulating air oven for 5 minutes at 275°F. Control panels were prepared in the same manner except that they were oven dried following a one minute cold tap water rinse following the zinc phosphating step, or alternatively treated in commercial post-treatment solution containing about 0.04% chromic acid ($CrO_3$) at a pH of about 4 (80°F) for one-half minute following the cold water rinse and oven dried.

The panels were finished with a throw coat automotive body paint system consisting of an epoxy primer, an epoxy guide coat and a thermoset acrylic top coat and subjected to the standard salt spray test for 336 hours. The results are shown in Table IV.

TABLE IV

| Post-Rinse | Metal | Salt Spray (336 Hr.) | Humidity (336 Hr.) |
|---|---|---|---|
| Resin Solution | CRS | 0–1 | 10 |
| | GALV | N | G9 |
| Controls | | | |
| Dilute hexavalent chromium | CRS | N | G9/C9 |
| | GALV | N | G9 |
| Tap Water | CRS | 2–5 | VF9 |
| | GALV | 0–2 | MD4 |

The results show that with the melamine-formaldehyde resin rinse corrosion resistance as measured by salt spray and humidity resistance is much better than with a tap water final rinse and nearly as good as that given by a conventional dilute chromium containing rinse.

For most of the examples herein, humidity, as well as salt spray results, were obtained. However, except where specifically noted, all results were 10 (excellent).

EXAMPLE 2 (TABLE V)

An aqueous alkali metal phosphate solution was prepared in a five gallon laboratory spray tank from sodium dihydrogen phosphate and sodium chlorate. The phosphate solution, which contained 10 g/1 phosphate ions and 5 g/1 chlorate ions, was heated to 160°F. A number of 4 × 12 inch CRS panels were conventionally spray cleaned for one minute at 160°F, hot water rinsed for one-half minute, spray coated in the alkali metal phosphate solution for 1 minute, cold water rinsed for one-half minute, and spray rinsed for one-half minute in a solution of a water soluble melamine-formaldehyde resin prepared by dissolving 86.0 grams of Resin R19 in 21.5 liters at 80°F and adjusting the pH to 6.0 with 25% $H_3PO_4$ and oven dried for 5 minutes at 275°F (350°F for later examples). Control panels were prepared in a similar manner, except that they were oven dried following a one minute cold water rinse after the alkali metal phosphate solution treatment step, or alternatively treated in a commercial post-treatment containing 0.1% chromic acid at a pH of about 2.5 at 80° F and oven dried.

The panels were finished with the Dulux 704-6731 paint and subjected to the standard salt spray test for 168 hours and the standard humidity test for 336 hours. The results are presented in Table V.

TABLE V

| Post-Rinse | Salt Spray (168 Hr.) |
|---|---|
| Resin Solution | $0–1^{2s}$ |
| Controls | |
| Dilute - Chromium | 0–1 |
| Tap Water | $7–8^{10s}$ |

Again, the results show that the melamine-formaldehyde resin rinse performs much better than tap water as a final rinse, and nearly as good as the commercial chromium-containing rinse under salt spray conditions. All humidity results were excellent giving 10 ratings.

EXAMPLE 3 (TABLE VI)

TABLE VI

| | EXAMPLE 3 | | |
|---|---|---|---|
| | | Salt Spray (168 Hr.) | |
| Resin Conc. -g/l | pH 8 | | pH 4.5 |
| .25 | 8–10 | | 7–8 |
| 2.5 | 2–4 | | 0–3 |
| Controls | | | |
| Tap Water | $8–10^{14s}$ | | |
| Deionized Water | | $10–10^{11s}$ | |
| Chromium | | 0–1 | |

TABLE VII

| | EXAMPLE 4 | | |
|---|---|---|---|
| | | Salt Spray (672 Hr.) | |
| Resin Conc. - g/l | pH 8 | | pH 4.5 |
| .25 | 90%P | | 2–3 |
| 2.5 | 50%P | | $1–1^{2s}$ |
| Controls | | | |
| Tap Water | | 4–7 | |
| Deionized Water | | 4–7 | |
| Chromium | | 0–1 | |

SAE 1010 cold-rolled steel panels were treated in a chlorate accelerated in phosphate bath containing approximately 1% $PO_4$ and 0.5% chlorate. Several post-treatment solutions were prepared having different pH values and different concentrations of resin R9. The panels were treated in accordance with the procedure of Example 2 and painted with the Duflux 704–6731 paint. Control panels were treated in the same manner but were rinsed instead with tap water, deionized water, or the conventional chromium rinse. Salt-spray results are given in Table VI. These results show that the post-treatment of the invention is an improvement over that obtained by rinsing with either tap water or deionized water. Although improvement is obtained over a wide range of pH values and concentrations, greater improvement in corrosion resistance is obtained at pH values on the acid side and at concentrations in excess of .25 g/1.

EXAMPLE 4 (TABLE VII)

The procedure of Example 3 was followed except that the Duracron 200 paint was used in place of the Dulux 704-6731 paint. As shown in Table VII, the same effects due to pH and concentrations were observed as in the case of the Dulux 704-6731 paint.

EXAMPLE 5

The procedure of Example 2 was followed except that the post-treatment solution contained 3 g/1 of resin R19 and 0.19 g/1 of tannin T9 and was adjusted to a pH of 10.0. When the panel was painted with the Dulux 704-6731 paint and subjected to the salt spray corrosion test for 168 hours, a value of 0-1 was obtained

COMPARATIVE EXAMPLE A (TABLE VIII)

TABLE VIII

| COMPARATIVE EXAMPLE A | | | |
|---|---|---|---|
| Resin R19 without Tannin | Salt Spray (168 Hrs.) at Solution pH | | |
| Resin Conc. - g/l | pH8 | pH9 | pH10 |
| 0.5 | 7–8[9s] | | |
| " | | 8–9 | |
| " | | 7–8 | |
| 1.0 | 5–6[7s] | | |
| " | | 8–9 | |
| " | | | 6–8[8s] |
| 2.0 | 3–5 | | |
| " | | 3–7 | |
| " | | | 3–7 |
| 4.0 | 2–4 | | |
| " | | 2–4 | |
| " | | 2–4 | |
| Controls | | | |
| Tap Water | 6–8 | | |
| Deionized Water | 7–8 | | |
| Chromium | 0–1[s] | | |

The procedure of Example 5 was repeated except that a number of different post-treatment solutions were propared containing varying quantities of resin R19 and having pH's ranging from 8 through 10. Controls using a tap water, deionized water, and chromium rinse were run as before. The results are tabulated in Table VIII. While the resin solution imparted a corrosion-resistance better than that obtained with tap water or deionized water, the corrosion resistance did not compare to that obtained with the conventional chromium process.

COMPARATIVE EXAMPLE B (TABLE IX)

TABLE IX

| COMPARATIVE EXAMPLE B | | |
|---|---|---|
| Tannin T9 without Resin | | |
| Tannin Conc. - g/l | pH | Salt Spray (168 Hr.) |
| 0.125 | 7.7 | 5–7 |
| " | 8.0 | 3–4[5s] |
| " | 10.0 | 4–5 |
| 0.25 | 7.7 | 6–6 |
| " | 9.0 | 4–5 |
| " | 10.0 | 4–4 |
| 0.50 | 7.9 | 6–7 |
| " | 9.0 | 4–5 |
| " | 10.0 | 6–7[8s] |
| 1.0 | 7.9 | 6–8 |
| " | 9.0 | 5–6[7s] |
| " | 10.0 | 6–7 |
| 2.0 | 8.0 | 6–8 |
| " | 9.0 | 7–8[9s] |
| " | 10.0 | 7–8[9s] |
| Controls | | |
| Tap Water | 5–7 | |
| Deionized Water | 6–7[8s] | |
| Chromium | N | |

The procedure of Example 5 was again repeated except that a solution containing only tannin T9 at varying concentrations and varying pH's was employed as the post-treatment. Results set forth in Table IX show that the corrosion resistance obtained with the solution containing the tannin alone does not compare with the conventional chromium rinse. Furthermore, a comparison of Example 5 with comparative Examples A and B shows that while the combination of the melamine-formaldehyde resin and the tannin does produce results comparable to that obtained in the conventional dilute chromium rinse, not nearly as good results can be obtained when either the resin or the tannin is employed alone.

EXAMPLE 6 (TABLE X)

TABLE X

| EXAMPLE 6 | | |
|---|---|---|
| Melamine-Formaldehyde | Salt Spray (168 Hrs.) | |
| Resin | Without Tannin | With Tannin T9 |
| R1 | 4–6[8s] | 0–1 |
| R2 | 2–6[8s] | 0–1 |
| R3 | 4–7[8s] | 0–1 |
| R4 | 2–4[6s] | 0–1 |
| R5 | 3–6 | 0–1[s] |
| R6 | 2–5 | 0–1[s] |
| R7 | 4–8[9s] | 0–1 |
| R8 | 4–8 | 0–1 |
| R9 | 2–7[10s] | N |
| R10 | 5–8[9s] | 0–1 |
| R11 | 4–7 | 0–1[2s] |
| R12 | 6–9[10s] | 0–1 |
| R13 | 3–5[6s] | 0–1 |
| R14 | 5–8[9s] | 0–1 |
| R15 | 4–9 | 0–1 |
| R16 | 2–5[6s] | 0–1 |
| R17 | 5–7 | 4–6 |
| R18 | 6–8 | 1–2 |
| Controls | | |
| Tap Water | 6–8[9s] | |
| Deionized Water | 5–8[10s] | |
| Chromium | 0–1 | |

The procedure of Example 2 was repeated except that separate post-treatment solutions were prepared to contain 4 g/1 of different melamine-formaldehyde resins with the pH djusted to 9.0, both with and without 0.25 g/1 of tannin T9. The salt spray results after 168 hours are reported in Table X. Controls were run as in the previous examples. The results show that the combination of the resin and the tannin gave far superior corrosion resistance as measured by salt spray as compared to use of the resins alone.

EXAMPLE 7 (TABLE XI)

TABLE XI

| EXAMPLE 7 | | | |
|---|---|---|---|
| Resin R19 plus | Salt Spray (366 Hr.) at Solution pH | | |
| Tannin | 8.0 | 6.0 | 4.0 |
| T1 | 1–1[2s] | 1–1[4s] | 1–3[4s] |
| T2 | 0 –1[s] | 0–1 | 1–1 |
| T3 | 0–1[2s] | 0–1[2s] | 1–1[2s] |
| T4 | 0–1 | 0–1[3s] | 1–2[5s] |
| T5 | 1–3 | 1–2[7s] | 2–4[8s] |
| T6 | 1–3 | 1–3[4s] | 1–3[4s] |
| T7 | 1–1[2s] | 1–1[2s] | 1–4 |
| T8 | 0–1 | 1–2 | 1–2 |
| T9 | 0–1[s] | 0–1[s] | 0–1[s] |
| T10 | 0–1 | 0–1 | 0–1[2s] |
| T11 | 0–1 | 0–1 | 0–1[s] |
| Controls | | | |
| Tap Water | 45% P | | |
| Deionized Water | 55%P | | |
| Chromium | 0–1 | | |
| Resin R19 only, pH 7 | 4–12[15s] | | |
| Tannin T9 only, pH 5 | 8–11[15s] | | |

The procedure of Example 2 was again repeated except that separate post-treatment solutions were prepared to contain 4 g/1 of resin R19 and 0.25 g/1 of various types of tannins and the solutions were adjusted to pH values ranging from 4 to 8. When the salt spray results, after 336 hours, are compared with those of the controls in Table XI, it is observed that the post-treatment solution containing both the resin and the tannin produces a much greater degree of corrosion resistance over a broad range of pH vaues than that obtained through the use of tap water, deionized water, or either the resin or tannin alone. Results obtained are as good as or almost good as those obtained with the use of the dilute chromium-containing rinse.

EXAMPLE 8 (TABLE XII)

TABLE XII

EXAMPLE 8
Resin & Tannin = 4 g/l

| Wt. Ratio Resin/Tannin | Salt Spray (168 Hrs.) Dulux 704-6731 | Salt Spray (168 Hrs.) Duracron 200 Paint |
|---|---|---|
| 1/30 | 7–9 | 70% P |
| 1/15 | 4–7 | 60% P |
| 1/7.5 | 4–5 | 5–8 |
| 1/3.75 | 5–8 | 85% P |
| 1/1 | 1–4 | 3–3[4s] |
| 2.75/1 | 0–1[s] | 0–1 |
| 7.5/1 | N | 0–1[s] |
| 15/1 | N | 0–1 |
| 30/1 | 0–1 | 0–1[2s] |
| Controls | | |
| Tap Water | 9–10 | 3–4 |
| Deionized Water | 8–10 | 2–3 |
| Chromium | 0–1[s] | 0–1 |

The procedure of Example 2 was repeated except that the post-treatment solution was made up to contain 4 g/1 of resin R19 plus tannin T9. The pH was adjusted to 8.5 and the weight ratio between the resin and the tannin in the solution was varied while maintaining the total concentration at 4 g/1. Panels were separately tested with the Dulux 704-6731 and the Duracron 200 paint. The salt-spray results after 168 hours are given in Table XII. These results show that a weight ratio of resin to tannin of at least 1:1 is desired in order to obtain salt spray results approaching these obtained with the conventional dilute chromium rinse. A ratio of 3.75 : 1 or above produces results as good as or better than those obtained with a dilute chromium rinse. While the paint employed affects the over-all spray results, the post-treatment improves the corrosion resistance for both paint systems.

EXAMPLE 9 (TABLE XIII)

TABLE XIII

EXAMPLE 9
Resin/Tannin = 16/1

| Resin R19 Concentration-g/l | Salt Spray (336 Hr.) |
|---|---|
| 0.2 | 60% P |
| 0.4 | 2–5 |
| 0.8 | 1–1 |
| 1.6 | 0–1 |
| 3.2 | 0–1 |
| 6.4 | 0–1 |
| Controls | |
| Tap Water | 80% P |
| Deionized Water | 90% P |
| Chromium | 0–1 |

The procedure of Example 8 was repeated except the weight ratio of the resin to the tannin was maintained at 16 : 1 while the resin concentration was varied from 0.2 to 6.4 g/1. The pH was maintained at a value of 7.0. The results are shown in Table XIII. These results show that at the weight ratio employed, a resin concentration of above 0.4 g/1 is necessary in order to obtain salt spray corrosion results approaching these obtained with the dilute chromium rinse. As the concentration of resin increased to the level of 6.4 g/1, the humidity resistance decreased to 9.

EXAMPLE 10 (TABLE XIV)

TABLE XIV

EXAMPLE 10
Resin/Tannin = 7.5

| Resin R20 Concentration - g/l | pH | Salt Spray (168 Hr.) |
|---|---|---|
| 0.45 | 9.2 | 3–5 |
| 0.90 | 9.7 | 1–1 |
| 1.35 | 9.9 | 0–1[s] |
| 1.8 | 9.9 | 1–2 |
| 1.8 | 4.0 | 1–2 |
| Controls | | |
| Tap Water | | 7–10 |
| Deionized Water | | 9–10 |
| Chromium | | 0–1[s] |

The procedure of Example 9 was repeated except that resin R20 was employed in place of resin R19 and the weight ratio of the resin to the tannin was adjusted to 7.5 : 1. Results are presented in Table XIV. These results show that, at the weight ratio and pH values employed, a resin concentration in excess of 0.45 g/1 is desirable in order to obtain salt spray results comparable to those obtained with the dilute chromium rinse.

EXAMPLE 11

An aqueous alkali metal phosphate coating solution was prepared in a five gallon laboratory spray tank from sodium dihydrogen phosphate and sodium chlorate. The phosphate solution, which contained 10 g/1 phosphate ions and 5 g/1 chlorate ions, was heated to 160° F. In a second spray tank, a conventional alkaline cleaner was prepared at a concentration of one ounce per gallon and was heated to 150° F. In a third spray tank, a post-rinse solution containing a water soluble melamine-formaldehyde resin and a condensed tannin was prepared by dissolving 80 grams Resin R19 and 20 grams of a solution consisting of 25 parts tannin T9, 1 part NaOH, and 74 parts water in twenty liters water. The solution (which contained 4 g/1 Resin and 0.25 g/1 Tannin) had a pH as prepared of approximately eight, but, before use, was adjusted to a value of 6.4 with 25% phosphoric acid. All post-treatment rinses were used at ambient temperatures. A number of 4 × 12 inch SAE 1010, cold rolled, steel panels were sprayed in the sequence one minute cleaner, one-half minute fresh warm water rinse in an auxillary spray tank, one minute alkali metal phosphate coating solution, one-half minute cold water rinse, and one-half minute resin/tannin post-treatment solution, after which they were dried in a circulating air oven for five minutes at 325° F. Other sets of panels were processed similarly, except that the pH of the post-rinse solution was adjusted to values of 5.2 and 3.0 with 25% phosphoric acid. Control panels were prepared in the same manner except that they were oven dried following the one-half minute cold water rinse, or alternatively treated in a commercial post-treatment solution containing approximately 0.1% chromic acid for one-half minute following the cold water rinse and oven dried.

The panels were divided into three sets and then finished with three different paint systems. After finishing, the panels were subjected to the standard salt spray test for 336 hours, the results of which are shown in Table XV.

TABLE XV

| EXAMPLE 11 Resin/Tannin = 16/1 | | | |
|---|---|---|---|
| Post-Treatment pH | Dulux 704-6731 | DuPont 963-72724 | PPG 222-1005 |
| 6.4 | 0–1[s] | 0–1[s] | 0–1[4s] |
| 5.2 | 0–1 | N | 1–1[3s] |
| 3.0 | 2–5[6s] | 0–1[s] | 1–1[2s] |
| Controls | | | |
| Chromium | 0–1 | 0–1[s] | 0–1 |
| Tap Water | 80%P | 9–12 | 2–4 |

The results show that under the conditions employed with the melamine-formaldehyde resin/tannin rinse corrosion resistance as measured by salt spray is much better than with a tap water rinse and nearly as good as that given by a conventional chromium containing rinse over a wide range of pH values regardless of the type of paint employed. More consistant results are obtained above pH3.

EXAMPLE 12

Aluminum zinc galvanized and cold-rolled steel panels were treated with various phosphatizing solutions and post-treated with a combination melamine-formaldehyde resin and tannin solution with a weight ratio of resin to tannin of approximately 16 : 1. The phosphate baths employed included those containing various combinations of chlorate, fluoride, nitrate, nickel, zinc, molybdate, and ammonium. As in the previous examples, the post-treatment of the present invention was employed at a concentration of about 4 g/1. The salt spray corrosion resistance was better than that obtained with tap water or deionized water and in most cases, comparable to that obtained with the use of the conventional dilute chromium rinse.

EXAMPLE 13 (TABLE XVI)

The procedure of Example 2 was repeated except that the post-treatment solution contained 1.6 g/1 of resin R9 and 0.22 g/1 of tannin T9 adjusted to a pH of 8.0. The bath was maintained at room temperature while the temperature of oven drying was varied from 275° to 425° F. Results are shown in Table XVI. These results show that while improved corrosion resistance can be obtained at low dry-off temperatures, elevated temperatures are preferred in order to obtain corrosion resistance comparable to that obtained for the dilute chromium rinse.

EXAMPLE 14 (TABLE XVII)

The procedure of Example 2 was repeated except that the post-treatment solution contained 1.6 g/1 of resin R20 and 0.22 g/1 of tannin T9 adjusted to a pH of 8.5–8.8. The bath was maintained at room temperature while the temperature

TABLE XVI

| EXAMPLE 13 | |
|---|---|
| Oven Temperature - ° F | Salt Spray (336 Hr.) |
| 275 | 3–3[8s] |
| 325 | 0–1[3s] |
| 350 | 0–1[7s] |
| 375 | 1–3[5s] |
| 425 | 1–2[4s] |
| Controls | |
| Deionized Water | 96% P |
| Chromium | 0–1 |

TABLE XVII

| EXAMPLE 14 | | |
|---|---|---|
| Time - Min. | Oven Temperatures - ° F | Salt Spray (168 Hr.) |
| — | Air Dried | 2–3 |
| 5 | 250 | 1–1 |
| 5 | 300 | 0–1 |
| 1 | 350 | 1–2 |
| 3 | 350 | 0–1 |
| 5 | 350 | 0–1 |
| 5 | 400 | 0–1 |
| 5 | 450 | 0–1 |
| Controls | | |
| Chromium | | 0–1 |
| Deionized Water | | 50% P |

of oven drying was varied from 250 to 450° F. The time in the oven was varied from 1 to 5 minutes. Salt spray results after 336 hr. are shown in TABLE XVII. These results show that while much improved corrosion resistance can be obtained by air drying or short time-low temperature dry-offs, longer time-higher temperature dry-offs are preferred in order to obtain corrosion resistance comparable to that obtained for the dilute chromium rinse.

EXAMPLE 15 (TABLE XVIII)

TABLE XVIII

| EXAMPLE 15 | | | | | |
|---|---|---|---|---|---|
| | | Automotive Body System | | Dulux 704-6731 | |
| Post-Treatment | Metal | Salt Spray (336 Hr.) | Humidity (336 Hr.) | Salt Spray (336 Hr.) | humidity (336 Hr.) |
| A | cRS | 0–1 | 10 | 2–3 | VF9 |
| | GALV | N | 10 | 0–1 | 10 |
| B | CRS | 0–1[s] | 10 | 3–5 | 10 |
| | GALV | N | 10 | 0–1 | 10 |
| C | CRS | 0–1[s] | 10 | 1–2 | 10 |
| | GALV | N | C9 | 1–1 | 10 |
| Controls | | | | | |
| Chromium | CRS | 0–1[3s] | 10 | 3–6 | VF9 |
| | GALV | N | 10 | 0–1[s] | 10 |
| Deionized Water | CRS | 3–4 | 10 | 12–12[14s] | c8/F9 |
| | GALV | 2–3 | C9 | 4–6[7s] | 10 |
| Tannin T9 0.25 g/l pH 4.6 | CRS | 0–2 | 10 | 3–7 | VF9 |
| | GALV | N | 10 | 1–1[2s] | 10 |

An aqueous acidic zinc phosphate coating solution was prepared in a five-gallon laboratory spray tank to contain 1.2 g/l zinc ions, 1.0 g/l nickel ions, 1.0 g/l fluoride added as silicofluoride, 5.0 g/l phosphate ions, 2.0 g/l nitrate ions, and 0.1 g/l nitrite ions. This solution, when heated to 150° F, and when titrated in the conventional manner, was found to have a total acid of between 13.0 and 14.6 points, and a free acid of between 1.0 and 1.3 points. In a second spray tank, a conventional alkaline cleaner was prepared at a concentration of one once per gallon and was heated to 145°-150° F. A third spray tank was used to contain the melamine-formaldehyde resin/tannin post-treatment solutions detailed in Table XVIII. A number of 4 × 12 inch SAE 1010, cold rolled steel panels (CRS) and 4 × 12 inch minimum spangle commercial hot-dipped galvanized panels (GALV), temper rolled one percent, were sprayed in one sequence one minute cleaner, one-half minute fresh warm water spray rinse, 1 minute zinc phosphate solution, one-half minute cold water rinse, and one-half minute melamine-formaldehyde resin/tannin solution detailed in the table, after which they were dried in a circulating air oven for 5 minutes at 325°F. Control panels were prepared in the same manner except that they were oven dried following a one-half minute tap water rinse and a one-half minute deionzed water rinse, or alternatively treated in a commercial post-treatment solution containing about 0.04% chromic acid at a pH of about 4 at 80° F for one-half minute following the cold water rinse and oven dried. Other control panels were prepared in the same manner except that they were treated in a solution containing 0.25 g/1 of tannin T9 at a pH of 4.6 (adjusted with $H_3PO_4$) at 80° F for one-half minute following the cold water rinse and oven dried. In this example, all panels were oven dried for 5 minutes at 325° F.

The treated panels were finished with Dulux 704-6731 or the automatic body system of Example 1 and thereafter subjected to salt spray and humidity testing for 336 hours. System A contains 0.8 g/1 R9 and 0.11 g/1 T9 adjusted to pH 8.6 with NaOH. System B contains the same concentrations and components adjusted to pH 9.0. System C contains 0.85 g/1 R19 and 0.056 g/1 T9 adjustedto pH 9.0 with NaOH. The results are given in Table XVIII. The results show the corrosion resistance imparted employing the resin/tannin post-treatment over a zinc phosphate coating are comparable to that obtained with the conventional chromium and much better than that obtained using deionized water or the tannin alone.

What is claimed is:

1. In a method of post-treating a phosphate or chromate conversion coated metal surface without the use of chromium chemicals, the improvement comprising contacting said surface with an aqueous solution comprising at least 0.1 g/1 of a melamine-formaldehyde resin and at least 0.01 g/1 of least a vegetable tannin wherein the weight ratio of resin:tannin is at least 1:1.

2. The method of claim 1 wherein said resin concentration is not in excess of 100 g/1.

3. The method of claim 2 wherein the resin concentration is from 0.25 to 25 g/1.

4. The method of claim 1 wherein the pH of said solution is not in excess of 10.

5. The method of claim 1 wherein the post-treated surface is dried at an elevated temperature.

6. The method of claim 1 wherein the vegetable tannin is an extract.

7. The method of claim 1 wherein the melamine-formaldehyde resin is selected from the group consisting of the methylolated melamines and the $C_1$–$C_4$ alkyl derivatives thereof.

8. An aqueous concentrate composition useful for the post-treatment of a phosphate or chromate conversion coated metal surface comprising 1-80 wt. % melamine-formaldehyde and 1-40 wt. % of a vegetable tannin wherein the weight ratio of resin:tannin is at least 1:1.

9. The concentrate of claim 8 wherein the vegetable tannin is an extract.

10. The concentrate of claim 8 wherein the melamine-formaldehyde resin is selected from the group consisting of the methylolated melamines and the $C_1$–$C_4$ alkyl derivatives thereof.

11. The concentrate of claim 8 wherein said ratio is at least about 3.5:1.

12. The concentrate of claim 11 wherein said ratio is at least about 7.5:1.

13. The concentrate of claim 12 wherein the tannin is selected from the group of tannin extracts consisting of tannic acid, chestnut, guebracho, wattle and cutch.

14. An aqueous solution suitable for post-treating a phosphate or chromate conversion coated metal surface comprising at least 0.01 g/1 of a melamine-formaldehyde resin and at least 0.01 g/1 of a vegetable tannin wherein the weight ratio of resin:tannin is at least 1:1.

15. The solution of claim 14 wherein said ratio is at least about 7.5:1.

16. The solution of claim 15 wherein said ratio is at least about 7.5:1.

17. The solution of claim 14 having a pH value not in excess of 10.

18. The solution of claim 14 wherein the tannin is selected from the group of tannin extracts consisting of tannic acid, chestnut, guebracho, wattle and cutch.

* * * * *